US008438681B2

(12) United States Patent
Viberg

(10) Patent No.: US 8,438,681 B2
(45) Date of Patent: May 14, 2013

(54) FURNITURE DEVICE ADAPTED TO RECEIVE THE WEIGHT OF A BEING

(75) Inventor: Michael Viberg, Surahammar (SE)

(73) Assignee: Pass of Sweden AB (SE)

( * ) Notice: Subject to any disclaimer, the term of this patent is extended or adjusted under 35 U.S.C. 154(b) by 0 days.

(21) Appl. No.: 13/266,492

(22) PCT Filed: Apr. 20, 2010

(86) PCT No.: PCT/EP2010/055159

§ 371 (c)(1),
(2), (4) Date: Oct. 27, 2011

(87) PCT Pub. No.: WO2010/124964

PCT Pub. Date: Nov. 4, 2010

(65) Prior Publication Data

US 2012/0042454 A1 Feb. 23, 2012

(30) Foreign Application Priority Data

Apr. 27, 2009 (EP) ..... 09158832

(51) Int. Cl.
*A47C 23/28* (2006.01)
*A47C 23/053* (2006.01)

(52) U.S. Cl.
USPC ..... 5/716; 5/722; 5/727

(58) Field of Classification Search ..... 5/697, 716, 5/722, 727, 935, 936; 267/89
See application file for complete search history.

(56) References Cited

U.S. PATENT DOCUMENTS 2,558,288 A 6/1951 Backus
2,773,270 A * 12/1956 Rozelle ..... 5/253
3,058,778 A * 10/1962 Campbell ..... 297/452.5
3,059,249 A * 10/1962 Kamp ..... 5/246
4,222,137 A 9/1980 Usami
5,063,625 A * 11/1991 Perry ..... 5/697
7,458,121 B1 * 12/2008 Hsu ..... 5/716
7,934,277 B1 * 5/2011 Shu ..... 5/690
8,245,340 B2 * 8/2012 Hsu ..... 5/697
2006/0253994 A1 * 11/2006 Spinks et al. ..... 5/716

FOREIGN PATENT DOCUMENTS

AU 551300 B2 9/1983
WO 2005020760 A1 3/2005
WO 2005053466 A1 6/2005

OTHER PUBLICATIONS

International Search Report for PCT/EP2010/055159, Completed by the European Patent Office on Nov. 9, 2010, 3 Pages.

* cited by examiner

*Primary Examiner* — Michael Trettel
(74) *Attorney, Agent, or Firm* — Erickson, Kernell, Derusseau & Kleypas, LLC

(57) ABSTRACT

A furniture device comprising a section, having a fundament, a plate member, a first set of elastic members, an array of connections, a plurality of connection members attached to the first set of elastic members and to the fundament and a deformation member adapted to displace the plate member. Each elastic member comprises an elastic element having a first spring constant and a flexible envelope that encloses the elastic element. The connections located between the upper and lower ends of the elastic members forming an upper part with an upper length extending between the upper ends of the elastic members and the connections, and a lower part extending between the connections and the lower ends of the elastic members. The upper length is mainly unaffected by the displacement of the plate member and the lower length is adjustable by means of the displacement of the plate member.

18 Claims, 4 Drawing Sheets

FURNITURE DEVICE ADAPTED TO RECEIVE THE WEIGHT OF A BEING

CROSS-REFFERENCE TO RELATED APPLICATION

This application is the U.S. national phase of PCT Appln. No. PCT/EP2010/055159 filed Apr. 20, 2010 which claims priority to European application 09158832.7 filed Apr. 27, 2009, the disclosures of which are incorporated in their entirety by reference herein.

FIELD OF THE INVENTION

The present invention relates to a furniture device, such as a bed mattress, a seat cushion, etcetera, adapted to receive the weight of a being. The device comprises at least one section, wherein the section comprising a fundament adapted to be in connection with the ground, a plate member provided above the fundament with respect to the ground, a first set of elastic members arranged beside each other on the plate member and connected to each other by means of an array of connections, each elastic member comprising a length defined by an upper end and a lower end, and being adapted to be elastically deformed along said length when loaded with the weight of the being and to act on the being with a force that depends on said elastic deformation, a plurality of connection members attached to the first set of elastic members and to the fundament, and extending through the plate member, thereby attaching the first set of elastic members to the fundament, a deformation member adapted to displace the plate member in relation to the fundament, thereby variably deforming the elastic members.

PRIOR ART

In a furniture device, such as a bed mattress, a seat cushion, or other devices, is provided to act on the weight or part of the weight of a being, wherein the device distributes the weight from the body of the being over a part of a surface of the device. Depending on how the device distributes the weight of the being, the device will appear as being either soft or firm. The degree of firmness of such a device is dependent on the properties of the elastic elements, such as the spring constant, and how the elastic members have been mounted in the device, such as the degree of clamping or pre-tensioning. Thus, the firmness of the device is normally set at the manufacturing of the device.

In known furniture devices with properties according to the field of the invention, the firmness of the device is adjustable. By inducing deformation to the elastic members to different degrees, the firmness of the device is adjustable. The deformation member has the ability to deform the elastic member independently from the deformation of the elastic member induced by the being. This means that the firmness of the device is continuously adjustable during the operation of the device according to the wishes of the being. It is also possible to compensate the firmness of the device for possible changes in the elastic properties of the elastic arrangement over time.

Contemporary furniture devices often comprise elastic members with a so called pocket spring design, wherein each elastic member comprises an elastic element and a flexible envelope that encloses the elastic element so that the elastic element is clamped within the envelope. The pocket spring design has the advantage that each elastic member is deformed independently of its neighboring elastic members. However, pocket springs can not be applied to prior art furniture devices with adjustable firmness without losing the advantage provided by the pocket spring design.

U.S. Pat. No. 4,222,137 presents a bed with adjustable firmness. The bed comprises elastic members between a surface and a bottom plate. The elastic members are clamped between the surface and a bracket by means of connecting strings attached to the surface and to the bracket. The bottom plate is movable by means of a lifting device, wherein the deformation of the elastic members between the surface and the bottom plate is adjustable so that the firmness of the bed is adjustable. A problem with U.S. Pat. No. 4,222,137 is that a deformation of one part of the surface affects the deformation of a neighboring part of the surface. Another problem with U.S. Pat. No. 4,222,137 is that the lifting capacity and the length of stroke of the presented lifting devices are limited. Moreover, the lifting device provides no stability in a direction perpendicular to the movement of the bottom plate. Another problem with U.S. Pat. No. 4,222,137 is that only a single set of springs can be arranged between the surface and the bottom plate because if one spring is loaded all springs are effected so that a failure is likely to occur at the intersection between the two sets of springs.

U.S. Pat. No. 2,558,288 presents a bed with adjustable firmness with structure similar to U.S. Pat. No. 4,222,137, thus possessing the same problem as U.S. Pat. No. 4,222,137. A problem with U.S. Pat. No. 2,558,288 is that the firmness of the bed is depending on the weight it is being loaded with. If a part of the area of the surface is loaded with a weight, the firmness of neighboring surfaces area will increase. Thus, if a heavy person would load a part of the surface, the firmness will increase for a neighboring person of less weight. In addition, a problem with U.S. Pat. No. 2,558,288 is that the disclosed bed design is not functional due to the lifting device extending above the bottom plate and into the elastic members. Moreover, the lifting device requires space between the bottom plate and the bracket that will obstruct the attachment of the connecting strings to the bracket.

OBJECT AND SUMMARY OF THE INVENTION

The object of the present invention is to provide an improved furniture device comprising at least one section. A further object of the invention is a furniture device with improved firmness regulation without the disadvantaged of prior art. A further object of the invention is a furniture device comprising a firmness regulation with a maintained soft upper part in contact with the being.

This object is obtained by a furniture device as defined by the charactering portion of claim 1.

The first set of elastic members is a plurality of elastic members having their lengths mainly parallel with each other. The upper ends of the elastic members are adapted to receive the weight of the being directly or indirectly. The lower ends of the elastic members are adapted to be arranged on an upper side of the plate member. When the elastic elements are subjected to the weight of the being, the subjected elastic members are deformed along their lengths, wherein said force is created that opposes the deformation.

Each elastic member comprises the elastic element and the flexible envelope. The elastic element is enclosed in the flexible envelope so that the elastic element is clamped or pre-tensioned within the envelope. The elastic element is an element that responds to a deformation with a force that opposes the deformation. The dependency of the force to deformation is determined by the first spring constant of the elastic elements. The elastic element is for example an elastic material, a coil spring, a leaf spring etcetera.

The connection members are connecting the elastic members and the fundament, wherein the elastic members are clamped between the array of connections at the first set of elastic members and the upper side of the plate member. The deformation member is adapted to displace the plate member in relation to the fundament, thereby variably deforming the elastic members between the array of connections and the plate member, and likewise adjusting the degree of the clamping of the elastic members between the array of connections and the fundament.

The elastic members are maintained in parallel with each other by means of the array of connections located between the upper and lower ends of the elastic members. The array of connections is connecting the elastic member with each other. Thereby, the upper part and the lower part of the elastic members are formed. The length of each elastic member is the sum of the upper part and the lower part of the elastic member. The length of the upper part of the elastic members is mainly unaffected as the plate member is displaced and increases or decreases the deformation of the elastic members. The length of the lower part of the elastic members is adjusted by means of the displacement of the plate member. Since the lower part of the elastic members is adjustable, the total length of the elastic member is likewise adjustable. Thereby, the elastic members are clamped by means of the connection members between the array of connections and the fundament.

In an embodiment the section of the furniture device comprises two or more sets of elastic element. However, the invention may also be realized by means of a single set of elastic elements.

According to an embodiment of the invention, the deformation member is adapted to increase the firmness of the elastic members by increasing the deformation of the elastic members, and wherein the deformation member is adapted to decrease the firmness of the elastic members by decreasing the deformation of the elastic members.

According to an embodiment of the invention, the connection members are adapted to determine a maximal distance between said array of connections and the fundament. The connection members are adapted to pull the array of connections downwards towards the fundament so that the distance between said array of connections and the fundament does not exceed said maximal distance. In case the device is loaded with the weight of the being causing a deformation of only the upper part of the elastic members, the connection members are kept stretched between the array of connections and the fundament. In the stretched condition, the connections members affect the elastic member with a force that holds the elastic member towards the fundament at said maximal distance between the array of connections and the fundament. In case the device is loaded with the weight of the being causing a deformation of both the upper and the lower part of the elastic members, the connection members are relaxed between the array of connections and the fundament at a distance less than said maximal distance between the array of connections and the fundament. In the relaxed condition, the connections members do not affect the elastic member or the fundament with any force.

According to an embodiment of the invention, the section comprises a net member provided between the elastic members, the net member engaging the array of connections, wherein the connection members are attached to the net member, thereby attaching the first set of elastic members to the fundament. The net member is adapted to engage the array of connections so that there is a connection between the elastic members and the fundament by means of the connection members.

According to an embodiment of the invention, the array of connections is arranged between the envelopes of adjacent elastic members. The net member is shaped so that it engages the array of connections without contact to the ends of the elastic members.

According to an embodiment of the invention, the section comprises a second set of elastic members each comprising a length defined by an upper end and a lower end, and an elastic element having a second spring constant. In a preferable embodiment said first and second spring constant are different from each other. By means of the first and the second sets of elastic members said force depends on the degree of deformation of the elastic members. Thus, the firmness of the furniture device will depend on the degree of deformation of the elastic members.

According to an embodiment of the invention, the second set of elastic elements is located between the first set of elastic elements and the plate member. Thereby, the deformation of the first set of elastic members has a first firmness and the deformation of the second set of elastic member has a second firmness.

According to an embodiment of the invention, the furniture device comprises a control member adapted to control the deformation member. The control member has means to control the displacement of the plate member so that the deformation induced to the elastic elements is adjustably controlled. Hence, the firmness of the device is controlled by the control member.

According to an embodiment of the invention, the deformation member comprises:

a plurality of elongated displacement members extending beside the connecting members, wherein the displacement members engage the plate member, a drive unit adapted to act on the displacement members so that the plate member is being displaced towards the connections or towards the fundament.

The function of the elongated displacement members is to form a connection between the fundament and the plate member, and a support for carrying the plate member and the first set, and possible second set, of elastic members. The function of the drive unit is to act on the displacement members so that the plate member is displaced and increases or decreases the deformation of the elastic members.

According to an embodiment of the invention, the plate member has a shape with four corner areas and a central area, said displacement members engaging the corner areas and the central area of the plate member. By means of the position of the displacement members the plate member is stabilized in a direction perpendicular to the length of the elastic members.

According to an embodiment of the invention, the displacement members are non-rotating during said displacement. By means configuring the displacement members non-rotating, the risk of entanglement between the connection members and the displacement members is reduced.

According to an embodiment of the invention, the drive unit is positioned under the fundament, wherein the displacement member extends from the plate member through the fundament to the drive unit. Thereby, the length of stroke of the plate member is not restricted by the location of the drive unit.

According to an embodiment of the invention, the drive unit comprises a drive motor and a plurality of driving elements connected to the drive motor, each driving element engaging the respective one of the displacement members.

According to an embodiment of the invention, each connection member is a string, wire or any similar flexible element.

According to an embodiment of the invention, each elastic element comprises a central part, between the upper and the lower end, and an upper and a lower part, wherein the central part of the elastic element is in friction contact with an inner side of the envelope along the length of the elastic member, whereas the upper part of the elastic element is not in contact with the inner side, wherein the lower and central part of the elastic element is affected by the deformation induced by the displacement of the plate member, whereas the upper part of the elastic element is unaffected by the deformation induced by the displacement of the plate member.

By means of the friction contact between the central part of the elastic element and the inner side of the envelope and the lack of contact between the upper part of the elastic element and the inner side of the envelope, the upper part of the elastic element will not be affected by the deformation induced by the plate member. Thereby, the firmness of the upper part of the elastic element will be unaffected by the deformation induced by the plate member. Thus, the furniture device forms a soft upper part and lower part with adjustable firmness by means of the displacement of the plate member.

According to an embodiment of the invention, the central part of each elastic element is wider than an upper part so that friction contact is realized between the central part of the elastic element and the envelope. Thereby, the movement of the lower part of the elastic elements within the envelope is restricted.

According to an embodiment of the invention, a central part of the envelope is narrower than an upper part of the envelope so that so that friction contact is realized between the central part of the elastic elements and the envelopes. Thereby, the movement of the lower part of the elastic elements within the envelope is restricted.

According to an embodiment of the invention, the elastic element is free to move within the envelope. Thereby, the deformation induced to the elastic element by the plate member is homogeneous over the length of the elastic element.

According to an embodiment of the invention, the furniture device comprises a control member adapted to control the deformation member, wherein the section comprises a sensor adapted to measure a physical parameter proportional to a weight acting on the furniture device by the being and transfer measured information regarding the physical parameter to the control member, wherein the control member is adapted to control the displacement of the plate member based on said information. The physical parameter is for example pressure, weight, deformation, temperature, and etcetera. Thus, by means of the sensor, the weight subjected to the furniture device is measurable. The measured information is used as a basis for adjusting the position of the deformation member. For example, the measured information is used so that the deformation induced by the being does not exceed certain value.

According to an embodiment of the invention, the furniture device comprises at least a first section and a second section, wherein the firmness of each section is adjustable independently of the other section. For example, a section that is being subjected to more weight than another section is adjusted to higher firmness. In another example, the deformations of two or more sections are adjustable by means of adjusting each deformation member so that the two sections are deformed to similar degree by the being. Thereby, it is possible to adjust the firmnesses of the first and the second section so that the spine of a being lying on the furniture device is more straight that for a furniture device with only one firmness and hence providing a more ergonomic position for the being on the furniture device.

According to an embodiment of the invention, the first section comprising a first sensor and the second section comprising a second sensor, wherein the control member is adapted to control the displacement of the plate member of the first section and the second section, wherein the displacement of the plate member of each section is based on the measured information from the first sensor and the second sensor. According to an embodiment the control member is adapted to adjust the position of each plate member so that the induced deformation to the first section and the second section is essentially equal. In an embodiment the control unit is adapted to automatic adjust the displacement of the deformation member based on a predetermined maximum allowed deformation of the sections. For example in an automatic adjustment mode, the control member adjusts the furniture device to higher firmness for a heavy person than for a lightweight person based on the measured information from the sensors. In an embodiment of the invention, the control member comprises a memory unit adapted to store one or more predetermined firmnesses for one or more sections of the furniture device, wherein the predetermined firmnesses of the furniture device is adapted to be actuated by means of the control member or by means of information from the sensors. In an embodiment of the invention the plurality of sections share the same fundament.

According to an embodiment of the invention, a surface on the upper end of the elastic member receives the weight of the being. In another embodiment, a third set of elastic members is positioned on the first and the second set of elastic members.

BRIEF DESCRIPTION OF THE DRAWINGS

The invention will now be explained more closely by the description of different embodiments of the invention and with reference to the appended figures.

DETAILED DESCRIPTION OF PREFERRED EMBODIMENTS OF THE INVENTION

Figure 1A:
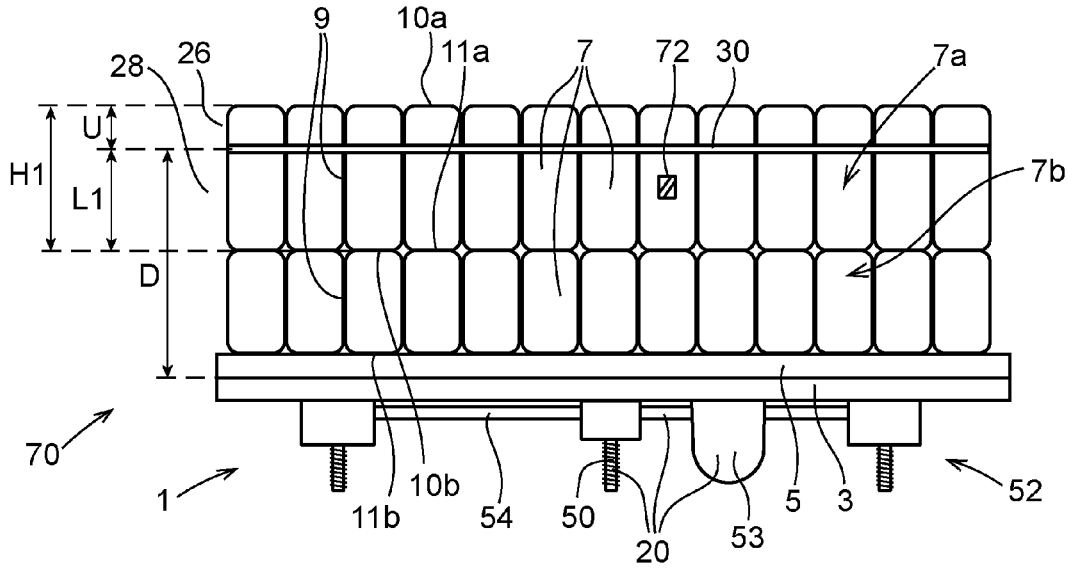
FIG. 1*a* shows a side view of a furniture device comprising a section in a first position
Figure 1B:
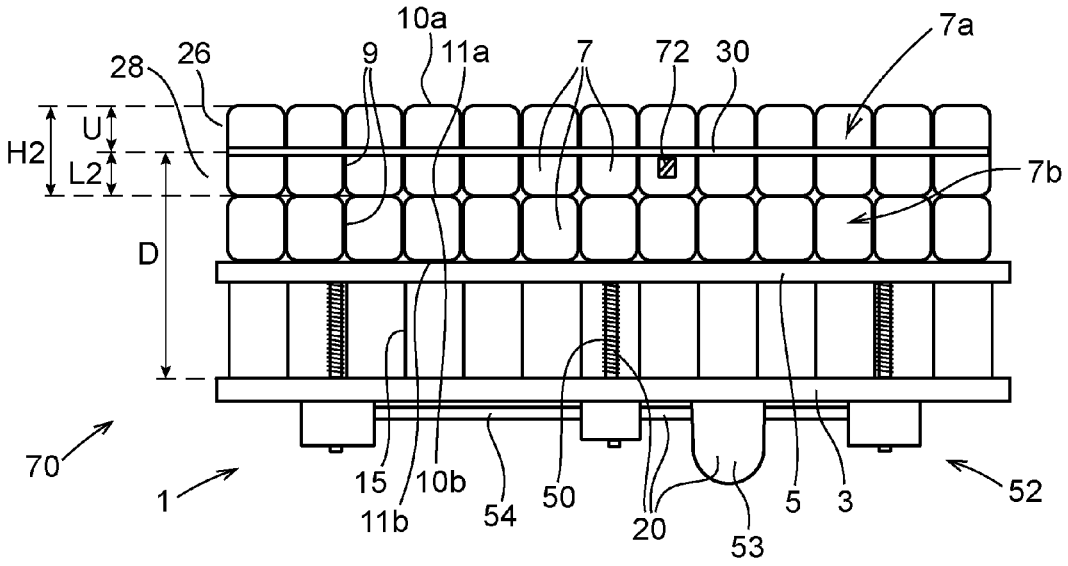
FIG. 1*b* shows a side view of the furniture device comprising the section in a second position

FIG. 1 shows a furniture device 1 with adjustable firmness according to the invention. The device comprises a section 70. The firmness of the section 70 is adjustable by means of displacement of a plate member 5 that increases or decreases an induced deformation to a first set 7*a* and a second set 7*b* of elastic members 7. In FIG. 1 the section 70 is in two different positions with different degree of induced deformation to the elastic members 7. In FIG. 1*a* and FIG. 1*b* the section 70 is in a first and second position respectively. In the first position the firmness of the section 70 is low, i.e. the section 70 is soft. In the second position the firmness of the section 70 is higher than in the first position. The first position constitutes a lowest firmness of the section 70. The second position merely illustrates one of the firmnesses of the section 70. The firmness of the section 70 might be adjustable to higher firmness than the firmness of the second position. The possible adjustable degree of firmness of the section 70 depends on the strength of the components of the section 70, such as the strength of the elastic members 7. Likewise, intermediate firmnesses between the first and the second positions are continuously adjustable.

The section 70 comprises a fundament 3 in connection with the ground. The fundament 3 provides stability to the section 70 and to the components of the section 70. The section 70 further comprises the plate member 5 situated above the fundament 3. The plate member 5 is preferably a flat body. The plate member 5 has a flat upper side that is adapted to support at least the first set 7*a* of elastic members 7. In FIG. 1 the first 7*a* and the second set 7*b* of elastic members 7 are arranged on the plate member 5. In each set of elastic members 7*a*, 7*b* the individual elastic members 7 are arranged besides each other.

Each elastic member 7 has an elongated shape with a length H1, H2 extending between an upper end 10*a*, 10*b* and a lower end 11*a*, 11*b*. The lower ends 11*b* of the second set of elastic members 7*b* are arranged on the upper side of the plate member 5. The lower ends 11*a* of the first set of elastic members 7*a* are arranged on the upper ends 10*b* of the second set of elastic members 7*b*. The invention is not restricted to one or two sets of elastic members 7*a*, 7*b*, but any number of sets of elastic members 7*a*, 7*b* may be applied on the plate member 5.

The elastic members 7 within each set of elastic members 7*a*, 7*b* are connected to each other by means of an array of connections 9, wherein neighboring elastic members 7 are connected to each other so that the lengths of the elastic members 7 within each set 7*a*, 7*b* are mainly parallel. The array of connection 9 is for example an elastic connection, such as a glue connection, between two neighboring elastic members 7*a*, 7*b*. Preferably, the elastic members 7 within each set of elastic members 7*a*, 7*b* have the same length. For example, all the lower ends 11*b* of the second set of elastic members 7*b* rest on the upper side of the plate member 5. Likewise, the lower ends 11*a* of the first set of elastic members 7*a* rests on the upper ends 10*b* of the second set of elastic members 7*b*. The array of connections 9 is arranged along the lengths of the elastic members 7 for both the first and the second set of elastic members 7*a*, 7*b* between the upper end 10*a*, 10*b* and the lower end 11*a*, 11*b*. Thereby, an upper part 26 and a lower part 28 of the first set of elastic members 7*a* are formed.

Each elastic member 7 comprises an elongated elastic element 22 that is enclosed within a flexible envelope 24. Each elastic element 22 comprises a length and an upper end 10 and a lower end 11. Preferably, the array of connections 9 is attached to the envelopes 24 of neighboring elastic members 7. The elastic element 22 is an element that responds to a deformation with a force that opposes the deformation. The elastic element 22 has a spring constant that defines the magnitude of the opposing force that is created when the elastic element 22 is deformed along its length. The elastic element 22 is for example different types of elastic springs or other elastic elements 22 with the ability to create the opposing force. The elastic element 22 has a relaxed length that is longer than the length of the envelope 24. Thereby, the elastic element 22 is clamped or pre-tensioned within the envelope 24. The elastic elements 22 of the first set and the second set of elastic members 7*a*, 7*b* have different spring constants. However, it is possible to arrange the first set and the second set of elastic members 7*a*, 7*b* with the same spring constant. Preferably, the first spring constant is lower than the second spring constant.

The envelope 24 is flexible and shaped in essential conformity with its elastic element 22. The envelope 24 has strength to clamp or pre-tension the elastic element 22 to a predetermined length that is shorter that the relaxed length of the elastic element 22. The envelope 24 is flexible in that the envelope 24 follows the deformation of the elastic member 7. At same time the envelope 24 is inflexible in that the elastic element 22 is restricted to a maximum predetermined length set by a length of the envelope. Each elastic element 22 has an elongated shape, such as the form of a cylinder, ellipsoid, parallelepiped, etcetera.

A plurality of connection members 15 are attached to a net member 30 and to the fundament 3. The net member 30 engages the array of connections 9, wherein the array of connection 9 engages the envelope 24 of the elastic members 7. The net member 30 is preferably a essentially solid grid shaped element extending between neighbouring elastic elements. The connections members 15 are extending from the net member 30 downwards through holes in the plate member 5 to the fundament 3. Thus, by means of the connections members 15 a connection is established between the first set of elastic members 7*a*, at the location of the array of connection 9, and the fundament 3. The connections members 15 determine a maximum distance D between the array of connections 9 and the fundament 3. The maximum distance D occurs as the device 1 is in unloaded condition independently of the position of the plate member 5. The lower part 28 of the first set of elastic members 7*a* and the whole second set of elastic members 7*b* are clamped between the attachment of the connections members 15 to the elastic members 7*a* and the attachment of the connections members 15 to the fundament 3. By means of the attachment of the connections members 15 to the elastic members 7, the upper part 26 of the first set of elastic member 7*a* is formed between the array of connections 9 and the upper ends 10*a* of the first set of elastic members 7*a*. The upper part 26 has an upper length U that is mainly unchanged by the displacement of the plate member 5. The function of the upper part 26 of the first set of elastic member 7*a* is to provide the feature of individual deformable elastic members 7. Hence, the upper part 28 of each elastic member in the first set of elastic members 7*a* is deformable without interaction with the neighboring elastic members 7. Thus, the upper part 26 of the first set of elastic members 7*a* has the characteristics of the pocket spring design with an soft upper layer. The length of the lower part 28 of the first set of elastic members 7*a* extends from the array of connections 9 at the elastic members 7 to the ends 11*a* of the first set of elastic members 7*a*. The lower part 28 of the first set of elastic members 7*a* is affected by the displacement of the plate member 5. Hence, the length of the lower part 28 of the first set of elastic members 7*a* is adjustable so that the firmness of the lower part 28 of the first set of elastic members 7*a* is adjustable.

The connection members 15 clamp the lower part 28 of the first set of elastic members 7*a* and the whole second set of elastic members 7*b* between the location of the array of connections 9 and the fundament 3. Thus, the firmness of the lower part 28 of the first set of elastic members 7*a* and the second set of elastic members 7*b* is adjustable by the deformation induced by the displacement of the plate member 5. By comparing FIGS. 1*a* and 1*b*, it is seen that the plate member 5 in FIG. 1*b* has been displaced to an elevated position compared to an end position at the fundament 3 in FIG. 1*a*. In this process, the length of upper part U of the first set of elastic members 7*a* has been maintained while the length of the lower part 28 of the first set of elastic members 7*a* has been compressed from a first length L1 to a second length L2. By the induced deformation to the lower part 28 of the first set of elastic members 7*a* in FIG. 1*b* in comparison to FIG. 1*a*, the firmness of the lower part 28 of the first set of elastic members 7*a* has been increased while the firmness of the upper part 26 of the first set of elastic members 7*a* has been essentially maintained.

The plate member 5 is adapted to be displaced in relation to the fundament 3 by means of a deformation member 20. The deformation member 20 comprises a plurality of elongated displacement members 50 that extend from the fundament 3 in parallel with the connection members 15 to the plate member 5. The displacement members 50 are adapted to displace the plate member 5 in parallel to the length of the elastic members 7 towards the array of connections 9 or towards the fundament 3. The deformation member 20 further comprises a drive unit 52 adapted to act on and transfer power to the displacement members 50 so that the plate member 5 is displaced in the desired direction.

Figure 4:
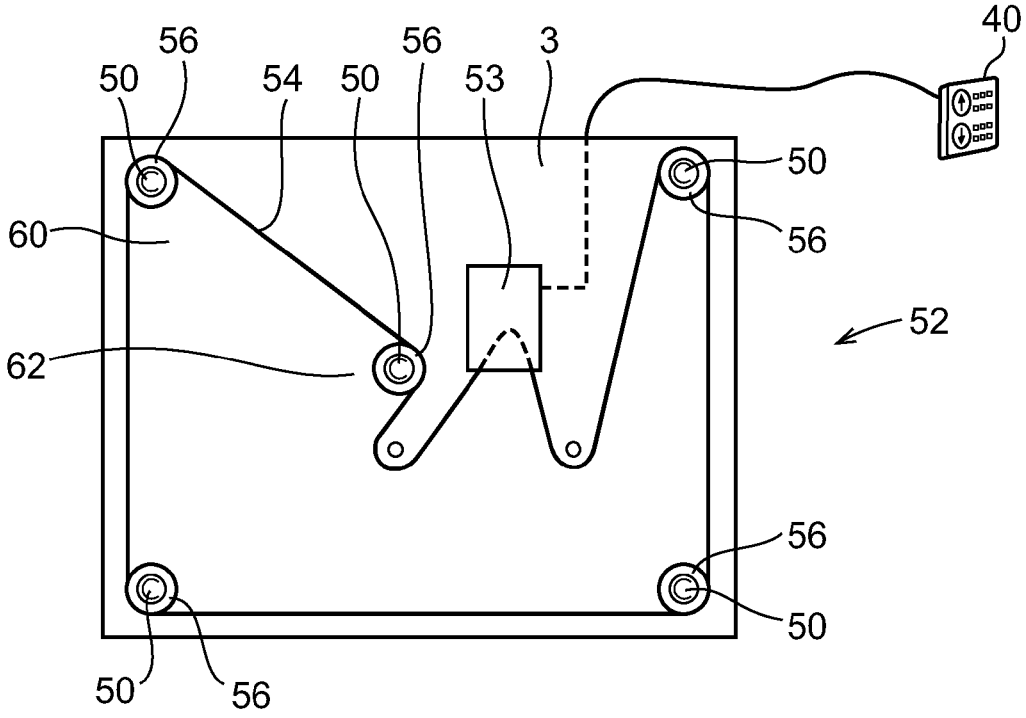
FIG. 4 shows the furniture device viewed from below

In FIG. 4 the furniture device 1 is viewed from below. Five elongated displacement members 50 are seen. Four displacement members 50 are positioned at the corner areas 60 of the fundament 3 and one displacement member is positioned at a central area 62 of the fundament 3. The displacement members 50 are correspondingly connected to the plate member 5 (not displayed). A drive unit 52 acts on the displacement members 50. The drive unit 52 comprises a drive motor 53, a transmission member 54, such as a belt, a chain, etcetera, and a plurality of driving elements 56. The drive motor 53 transfers power to the driving element 56 by means of the transmission member 54, such as a transmission belt. Each driving element 56 engages each displacement member. For example, the driving element 56 is a nut with an internal threading and each driving element 56 engages an external threading on the corresponding displacement member 50. The transmission member 54 rotates the driving elements 56 so that each displacement member 50 is displaced non-rotating upwards towards the elastic members 7 or downwards towards the fundament 3. The transmission member 54 is connected in a loop to each of the driving elements 56 so that power from the drive motor 53 is transmitted to the displacement members 50. The drive motor 53 is a motor such as an electric motor, a hydraulic motor, pneumatic motor, etcetera.

Figure 2A:
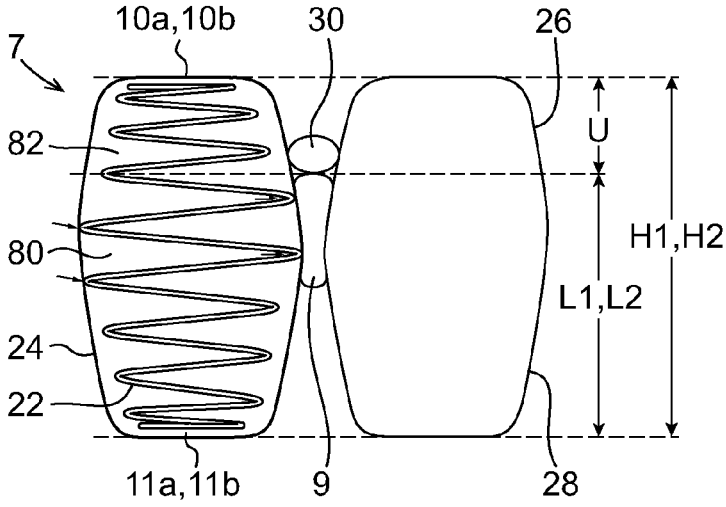
FIG. 2 shows examples of elastic members
Figure 2B:
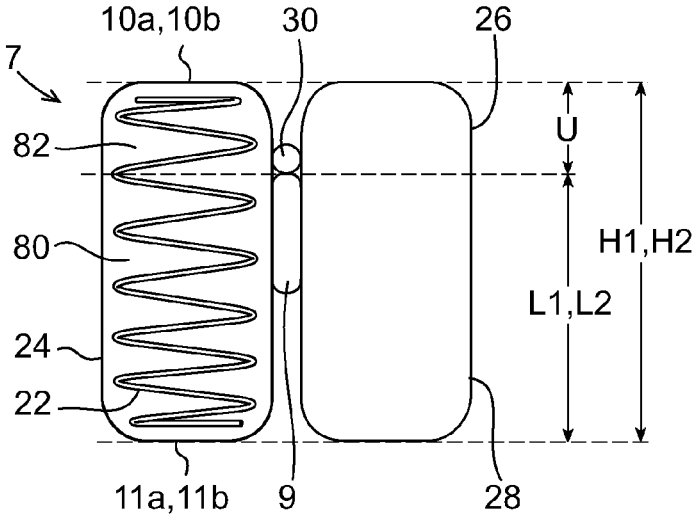

FIGS. 2*a* and 2*b* presents examples of elastic members 7 applicable for the invention. Two elastic members 7 are shown in each of FIGS. 2*a* and 2*b*. The left of the elastic member is shown in cross section displaying the interior of the elastic member and the right elastic member is shown from its exterior. The array of connections 9 connects the left and the right elastic members 7 on a central part 70 along the length of the elastic members 7 between the upper and lower ends 10*a*, 10*b*, 11*a*, 11*b*. The net member 30 engages the array of connection 9, wherein the connection members 15 are adapted to be attached to the net member 30. Each elastic member 7 comprises an elongated elastic element 22 and an envelope 24. The envelope 24 is shaped so that it encloses the elastic element 22. The elastic element 22 comprises a central part 80 and an upper part 82. The elastic element 22 is preferably a compression spring, for example a coil spring, a helical spring, etcetera. By means of the displacement of the plate member 5, the lower length L1, L2 of the elastic member is adjustable while the upper length U is mainly unaffected.

In FIG. 2*a* the central part 80 of each elastic element 22 is wider than its upper part 82 so that the central part 80 is in friction contact with the inner side of the envelope 24 while upper part 82 of each elastic element 22 lacks contact with the inner side if the envelope. The friction contact is indicated by arrows in the figure. By means of the friction contact between the central part 80 of the elastic element 22 and the envelope 24, the central part 80 of each elastic element 22 is restricted from moving within the envelope 24. Hence, the lower parts 28 of the elastic members 7 are affected by the displacement of the plate member 5 so that the firmness of the lower parts 28 is adjustable. On the other hand, the upper parts 26 of the elastic elements 22 are free to move within the upper part of the envelope 24 so that the upper parts of the elastic members 7 are mainly unaffected by the displacement of the plate member 5. Hence, the upper part 26 of the elastic members 7 will constitute a soft non-adjustable upper layer and the lower part 28 of the elastic members 7 will constitute a lower layer with adjustable firmness.

In FIG. 2*b* the central part 80 and the upper part 82 of each elastic element 22 has essentially the same width so that the elastic element 22 is free to move within the envelope 24. Since each elastic element 22 is free to move within its envelope 24, the firmness of the whole of the elastic element 22 is affected by the displacement of the plate member 5. Thus, the firmness of the upper 26 and the lower part 28 of the elastic members 7 will be essentially the same.

Figure 3:
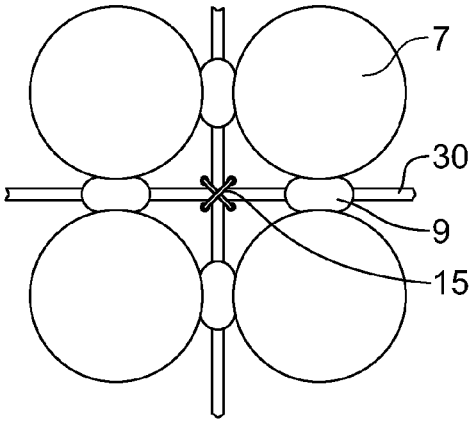
FIG. 3 shows a part of the furniture device viewed from above

In FIG. 3 a part of the furniture device 1 is viewed from above. Four elongated elastic members 7 with circular upper ends can be seen. Each elastic member 7 is connected to its closest neighboring elastic member 7 by means of the array of connections 9. The array of connections 9 engages the envelope 24 of the elastic members 7. The connection member 15 is attached to the net member 30 at a location between the elastic members 7, preferably at a free space between the four elastic members 7, such as at the intersection between two directions of the net member 30. The connection members 15 extend from the net member 30 along the length of the elastic member, through the plate member 5 and down to the fundament 3, where the connection members 15 are attached. Thereby, the elastic members 7 are clamped between the location of the array of connections 9 and the fundament 3.

Figure 5A:
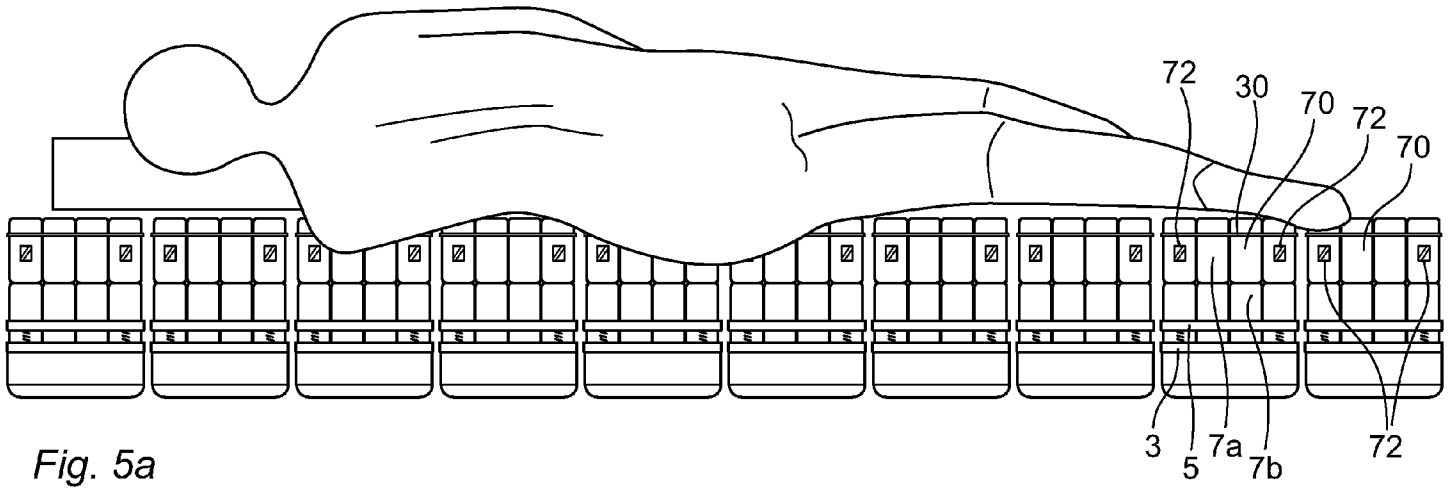
FIG. 5 shows a furniture device comprising a plurality of sections
Figure 5B:
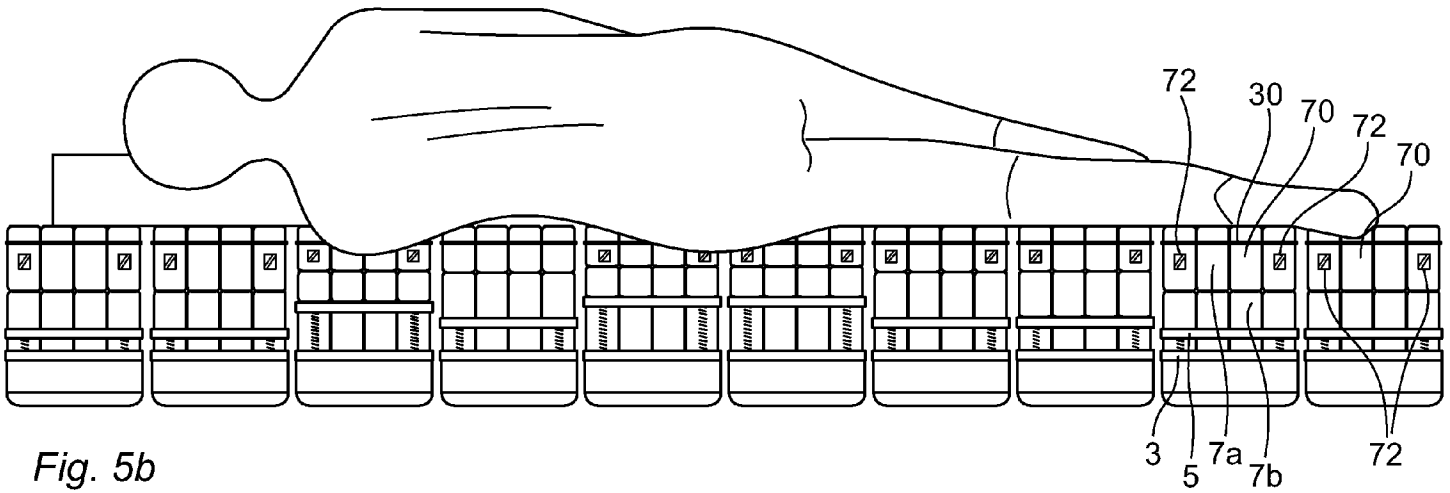

In FIGS. 5*a* and 5*b* a furniture device comprising ten essentially identical sections 70 is shown from a side view, wherein a being subjects the sections 70 with different weight due to different weight of different parts of the being. The firmness of each section 70 is individually adjustable. Each section 70 comprises the necessary components to achieve an adjustment of firmness according to the described invention. Thus, each section comprises a fundament 3, a plate member 5, at least a first set of elastic members 7*a* and preferably a second set of elastic members 7*b*, a plurality of connection members 15 and a deformation member 20. In an example, the sections 70 are positioned on a platform to elevate the sections 70 from the ground. In FIG. 5 each section 70 has a fundament 3. However, it is also possible that all sections 70 have one common fundament 3. The sections 70 are positioned next to each other so that the upper ends 10 of the sections 70 are aligned on essentially the same elevation.

In FIGS. 5*a* and 5*b*, the first set of elastic members 7*a* is positioned above the second set of elastic members 7*b*. The plate member 5 of each section 70 is adapted to be displaced independently. Each section 70 further comprises two sensors 72.

For example, the sensors 72 are positioned within an elastic element 7 or at the upper end of an elastic element 7. In the figure the sensors 72 are positioned at the rim of each section 70. The sensor is adapted to measure a physical parameter proportional to the weight of the being, such as pressure, weight, deformation, temperature, and etcetera.

In FIG. 5*a* the plate members 5 of all the ten sections 70 have the same vertical position. Hence, all the sections 70 have the essentially the same firmnesses. Thereby, the sections 70 subjected to heavy parts of the being is deformed more than sections 70 subjected to less heavy parts of the being. For example, the section subjected to the hip part of a person is deformed more than the section 70 subjected to the shoulder part due to that the hip part of a person usually is heavier than the shoulder part.

In FIG. 5*b* the plate members 5 of the ten sections 70 have individual adjusted position. Thereby, different sections 70 have different firmnesses. The section 70 subjected to the weight of the hip part and the shoulder part of the person has been adjusted so that the sections 70 are deformed substantially to the same degree. Thereby, the spine of the person is positioned in a straighter position in FIG. 5*b* than in FIG. 5*a*. Hence, FIG. 5*b* represents an improved ergonomic position for the person in comparison to FIG. 5*a*. Preferably, the furniture device 1 comprises sufficient number of sections 70 to allow an adjustment of the firmness of the section 70 so that the spine of the person is positioned in an essentially straight position.

In an example of use of the individual adjustable sections 70, the section 70 subjected to the weight of the head of the person is adjusted to a higher firmness in relation to the section 70 subjected to the rest of the body of the person. Thereby, the body of the person will deform the elastic members 7 more than the head so that the body of the person will be positioned in a lower elevation than the head. In some situation, such as for medical reasons or for personal preferences, it is desired to position the head in a higher elevation than the body. Thus, by means of the individual adjustable firmness of the different sections 70 of the furniture device 1, different part of the being can be positioned in different elevation in relation to each other.

The present invention is not limited to the embodiments disclosed but may be varied and modified within the scope of the following claims.

The invention claimed is:

1. A furniture device adapted to receive the weight of a being, the furniture device comprising at least one section, wherein the section comprising:

a fundament adapted to be in connection with the ground;

a plate member provided above the fundament with respect to the ground;

a first set of elastic members arranged beside each other on the plate member and connected to each other by means of an array of connections, each elastic member comprising a length defined by an upper end and a lower end, and being adapted to be elastically deformed along said length when loaded with the weight of the being and to act on the being with a force that depends on said elastic deformation;

a plurality of connection members connecting the elastic members at the array of connections between the first set of elastic members to the fundament, and extending through the plate member, thereby attaching the first set of elastic members to the fundament; and a deformation member adapted to displace the plate member in relation to the fundament; and thereby variably deforming the elastic members;

wherein each elastic member comprises an elastic element having a first spring constant and a flexible envelope that encloses the elastic element so that the elastic element is clamped within the envelope, said connections being located between the upper and lower ends of the elastic members, said connection dividing each of said elastic members between an upper part with an upper length extending between the upper ends of the elastic members and the connections, and a lower part with a lower length extending between the connections and the lower ends of the elastic members, wherein said upper length is mainly unaffected by the displacement of the plate member and said lower length is adjustable by means of the displacement of the plate member.

2. A furniture device according to claim 1, characterized in that the deformation member is adapted to increase the firmness of the elastic members by increasing the deformation of the elastic members and that the deformation member is adapted to decrease the firmness of the elastic members by decreasing the deformation of the elastic members.

3. A furniture device according to claim 1, wherein the connection members are adapted to determine a maximal distance between said array of connections and the fundament.

4. A furniture device according to claim 1, wherein the section comprises a net member provided between the elastic members, the net member engaging the array of connections, wherein the connection members are attached to the net member, thereby attaching the first set of elastic members to the fundament.

5. A furniture device according claim 1, wherein the array of connections are arranged between the envelopes of adjacent elastic members.

6. A furniture device according to claim 1, wherein the device comprises a second set of elastic members each comprising a length defined by an upper end and a lower end, and an elastic element having a second spring constant.

7. A furniture device according to claim 6, wherein the second set of elastic members is located between the first set of elastic members and the plate member.

8. A furniture device according to claim 1, wherein the furniture device comprises a control member adapted to control the deformation member.

9. A furniture device according to claim 1, wherein the deformation member comprises:

a plurality of elongated displacement members extending beside the connecting members, wherein the displacement members engage the plate member, a drive unit adapted to act on the displacement members so that the plate member is displaceable towards the connections or towards the fundament.

10. A furniture device according to claim 9, wherein the plate member has a shape with four corner areas and a central area, said displacement members engaging the corner areas and the central area of the plate member.

11. A furniture device according to claim 9 or 10, wherein the displacement members are non-rotating during said displacement.

12. A furniture device according to claim 9, wherein the drive unit is positioned under the fundament, wherein the displacement members extend from the plate member through the fundament to the drive unit.

13. A furniture device according to claim 9, 10, or 12, wherein the drive unit comprises a drive motor and a plurality of driving elements connected to the drive motor, each driving element engaging the respective one of the displacement members.

14. A furniture device according to any of the previous claims, wherein each connection member is a string, wire or any similar flexible element.

15. A furniture device according to claim 1, wherein each elastic element comprises a central part in friction contact with the envelope at the level of said array of connections, wherein the firmness of the upper part of the elastic members is mainly unaffected by the displacement of the plate member and the firmness of the lower part of the elastic members is adjustable.

16. A furniture device according to claim 1, wherein the furniture device comprises a control member adapted to control the deformation member, wherein the section comprises a sensor adapted to measure a physical parameter proportional to a weight acting on the furniture device by the being and transfer measured information regarding the physical parameter to the control member, wherein the control member is adapted to control the displacement of the plate member based on said information.

17. A furniture device according to claim 1, wherein the furniture device comprises at least a first section and a second section, wherein the firmness of each section is adjustable independently of the other section.

18. A furniture device according to claim 17, wherein the first section comprises a first sensor and the second section comprises a second sensor, wherein the control member is adapted to control the displacement of the plate member of the first section and the second section, wherein the displacement of the plate member of each section is based on the measured information from the first sensor and the second sensor.

* * * * *